US006822367B1

(12) United States Patent
Uchida et al.

(10) Patent No.: US 6,822,367 B1
(45) Date of Patent: Nov. 23, 2004

(54) BRUSH HOLDER DEVICE FOR DYNAMOELECTRIC MACHINE

(75) Inventors: Yasuaki Uchida, Kosai (JP); Naohito Kobayashi, Toyohashi (JP)

(73) Assignee: Asmo Co., Ltd., Shizuoka-ken (JP)

( * ) Notice: Subject to any disclaimer, the term of this patent is extended or adjusted under 35 U.S.C. 154(b) by 0 days.

(21) Appl. No.: 10/849,260

(22) Filed: May 20, 2004

(30) Foreign Application Priority Data

May 30, 2003 (JP) ..... 2003-155808

(51) Int. Cl.[7] ..... H01R 39/38
(52) U.S. Cl. ..... 310/242; 310/239
(58) Field of Search ..... 310/238–247

(56) References Cited

U.S. PATENT DOCUMENTS 3,710,160 A * 1/1973 Voglesonger ..... 310/247
5,648,695 A * 7/1997 Yamaguchi et al. ..... 310/242
6,288,469 B1 9/2001 Kimura et al. ..... 310/239
6,680,556 B2 * 1/2004 Menz et al. ..... 310/239
6,700,291 B2 * 3/2004 Uchida et al. ..... 310/239

* cited by examiner

*Primary Examiner*—Dang Le
(74) *Attorney, Agent, or Firm*—Posz & Bethards, PLC

(57) ABSTRACT

The brush holder device includes a holder base, metal brush holders and metal terminal plate elements. Each brush holder slidably receives a corresponding brush. Each brush holder includes securing claws, which are secured to the holder base by staking. Each securing claw includes a retorted portion, which is retorted toward a rear surface of the holder base beyond a top of a corresponding staking projection that projects from the rear surface of the holder base. Each metal terminal plate element also includes securing claws, each of which is similar to that of the brush holder.

17 Claims, 5 Drawing Sheets

BRUSH HOLDER DEVICE FOR DYNAMOELECTRIC MACHINE

CROSS REFERENCE TO RELATED APPLICATION

This application is based on and incorporates herein by reference Japanese Patent Application No. 2003-155808 filed on May 30, 2003.

BACKGROUND OF THE INVENTION

1. Field of the Invention

The present invention relates to a brush holder device, which securely holds brush holders of a dynamoelectric machine.

2. Description of Related Art

A brush holder device of a dynamoelectric machine, more specifically of a motor, generally includes metal brush holders and a holder base. Each brush holder receives a corresponding brush in a manner that allows sliding movement of the brush relative to a commutator. Furthermore, the brush holders are securely installed to a front surface of the holder base.

Each brush holder is bent to have a square horseshoe shaped cross section and includes a pair of lateral walls and a top wall. The top wall extends continuously from each of the lateral walls. A securing claw is formed in a lower edge of each lateral wall and is bent. More specifically, each securing claw is inserted through a corresponding receiving through hole formed in the holder base. A distal end of the securing claw, which protrudes from a rear surface of the holder base, is bent, so that the brush holder is secured to the holder base by staking.

At this time, each securing claw is desirably bent to make close contact with the rear surface of the holder base. However, due to springback property of the metal, it is difficult to bent the distal end of the securing claw in close contact with the rear surface of the holder base. Thus, the brush holder is loosely attached to the holder base. As a result, vibration of the brush, which is induced due to sliding engagement of the brush with the rotating commutator, causes wobbling of the brush holder, thereby generating noise.

In order to address the above disadvantage, it is conceivable to increase a press load applied to each securing claw to secure the securing claw to the holder base by the staking. However, when the press load becomes large, the holder base receives the large press load and may be thereby deformed or damaged.

Japanese Unexamined Patent Publication No. 11-27906, which corresponds to U.S. Pat. No. 6,288,469, addresses the above disadvantage by providing four diagonally bent securing claws in a brush holder. The four securing claws are inserted through corresponding securing through holes, which penetrate through a holder base at four corners of the brush holder. The diagonally opposed securing claws are bent toward each other, so that a side edge of each securing claw engages a peripheral edge (an inner peripheral surface) of the corresponding receiving through hole. In this way, wobbling of the brush holder relative to the holder base is more effectively limited.

However, in this case, since the side edges of the securing claws engage the peripheral edges of the corresponding receiving through holes, the receiving through holes, which penetrate through the holder base, are required. Thus, in the case where the holder base is relatively small and is made of resin, the provision of the receiving through holes reduces strength of the holder base. Thus, at the time of staking of the securing claws, a crack may be generated in the peripheral edge of the receiving through hole. Furthermore, this technique cannot be applied to a case where the securing claws are secured to the holder base only at peripheral edges of the holder base without providing the receiving through holes for receiving the securing claws.

The above disadvantages are also true in metal terminal plate elements, which are secured to the holder base by staking in a manner similar to that of the above brush holder and are electrically connected to electrical components, such as the brush.

SUMMARY OF THE INVENTION

The present invention addresses the above disadvantages. Thus, it is an objective of the present invention to provide a brush holder device, in which at least of one of each metal brush holder and each metal terminal plate element is more effectively secured to a holder base through staking of securing claws against the holder base.

To achieve the objective of the present invention, there is provided a brush holder device for a dynamoelectric machine. The brush holder device includes a holder base, at least one brush holder and at least one brush. The holder base has axially opposed first and second sides and includes a plurality of staking projections. Each staking projection projects from a base surface of the holder base on the second side of the holder base. The at least one brush holder is made from a metal plate that is bent into a predetermined shape and is securely installed to the first side of the holder base. Each of the at least one brush holder includes a plurality of securing claws, which are secured to the holder base by staking. Each securing claw includes a retorted portion, which is retorted toward the base surface on the second side of the holder base beyond a top of a corresponding one of the plurality of staking projections. Each of the at least one brush is received in a corresponding one of the at least one brush holder in a slidable manner in a sliding direction toward and away from a commutator of the dynamoelectric machine.

To achieve the objective of the present invention, there is provided a brush holder device for a dynamoelectric machine. The brush holder device includes a holder base, at least one brush holder, at least one brush and at least one terminal element. The holder base has axially opposed first and second sides and includes at least one staking projection, which projects from a base surface of the holder base on the second side of the holder base. The at least one brush holder is made from a metal plate that is bent into a predetermined shape and is securely installed to the holder base. Each of the at least one brush is received in a corresponding one of the at least one brush holder in a slidable manner in a sliding direction toward and away from a commutator of the dynamoelectric machine. The at least one terminal plate element is made from metal and is securely installed to the first side of the holder base such that the at least one terminal plate element is electrically connected to at least one of the at least one brush. Each of the at least one terminal plate element includes at least one securing claw, which is secured to the holder base by staking. Each of the at least one securing claw of each of the at least one terminal plate element includes a retorted portion, which is retorted toward the base surface on the second side of the holder base beyond a top of a corresponding one of the at least one staking projection.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

One embodiment of the present invention will be described with reference to the accompanying drawings.

Figure 1:
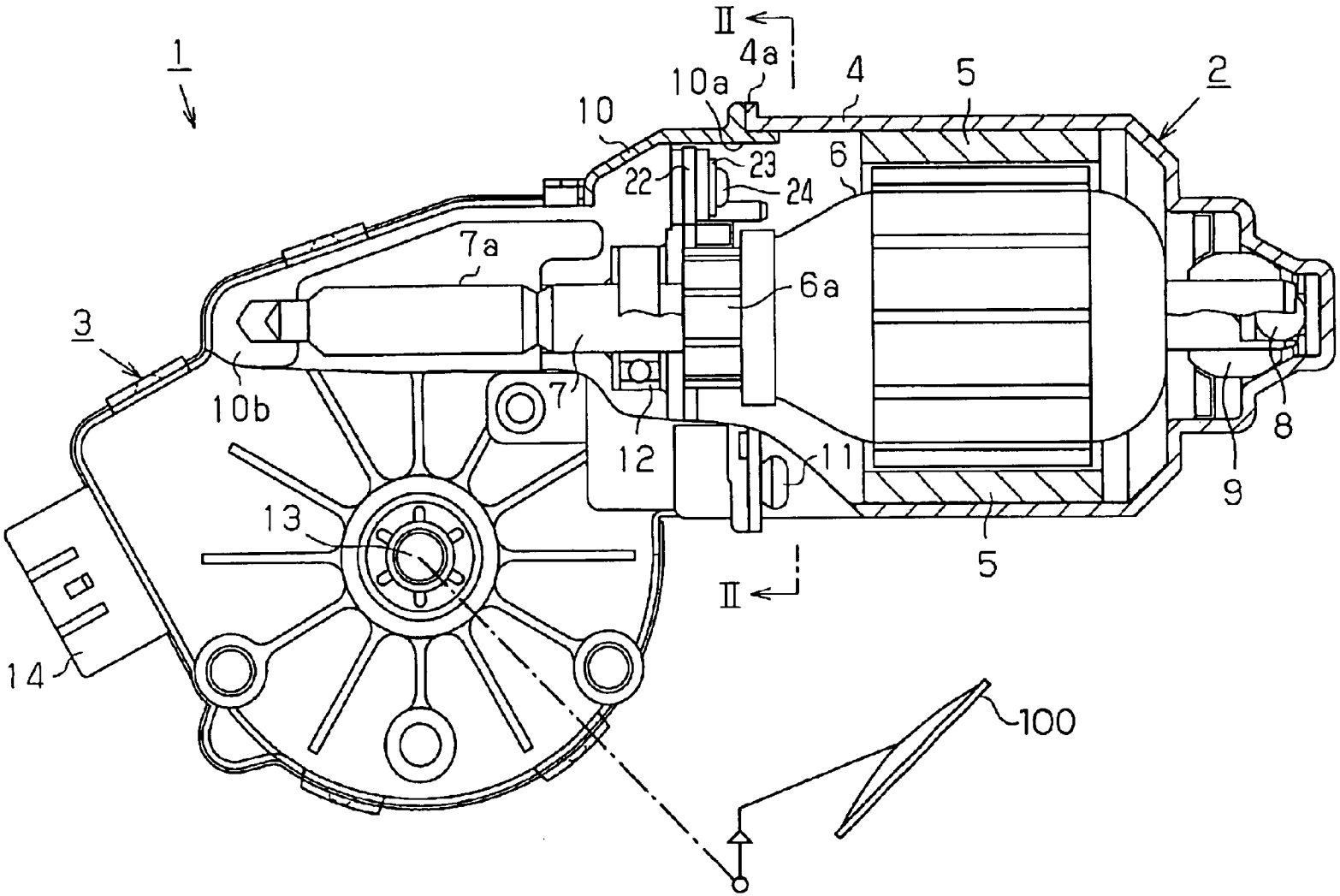
FIG. 1 is a cross sectional view of a wiper motor according to an embodiment of the present invention.

A wiper motor (a dynamoelectric machine) 1 shown in FIG. 1 is used as a drive source of a vehicle wiper system, which wipes rain droplets adhered to a windshield (front glass) through use of wipers 100 (only one is shown in FIG. 1). The wiper motor 1 includes a motor unit 2 and a speed reducing unit 3.

A yoke housing 4 of the motor unit 2 is made of an electrically conductive metal material and is formed into a cup shape. A plurality of magnets 5 is secured to an inner peripheral surface of the yoke housing 4. An armature 6 is rotatably received in the yoke housing 4 at a corresponding position that is radially inward of the magnets 5. A thrust bearing 8 and a radial bearing 9, both of which rotatably support a base end of a rotatable shaft 7 of the armature 6, are provided in a base of the yoke housing 4. A gear housing 10 of the speed reducing unit 3 is assembled to an opening 4*a* of the yoke housing 4 by screws 11 and covers a projected portion of the rotatable shaft 7, which is projected from the yoke housing 4.

The gear housing 10 is made of a metal material, such as aluminum alloy, and includes an opening 10*a* that has a shape, which generally coincides with that of the opening 4*a* of the yoke housing 4. Furthermore, the gear housing 10 is configured to receive a distal end side of the rotatable shaft 7 and an undepicted worm wheel. A bearing 12, which rotatably supports an intermediate portion of the rotatable shaft 7, is secured in the gear housing 10. Furthermore, a bearing part 10*b*, which rotatably supports a distal end of the rotatable shaft 7, is formed in the gear housing 10. A worm 7*a* is formed in the rotatable shaft 7 at an intermediate location between the bearing 12 and the bearing part 10*b* and is meshed with the undepicted worm wheel. An output shaft 13 is formed in the worm wheel in such a manner that the output shaft 13 extends perpendicular to the rotatable shaft 7. Rotation of the rotatable shaft 7 is decelerated and is outputted through the output shaft 13. The gear housing 10 is secured to an attachment bracket of a vehicle wiper system. Wiper arms of the wipers 100 are connected to the output shaft 13 through a link mechanism of the vehicle wiper system. When the output shaft 13 is rotated, each wiper 100 is swung to perform predetermined wiping movement.

Figure 2:
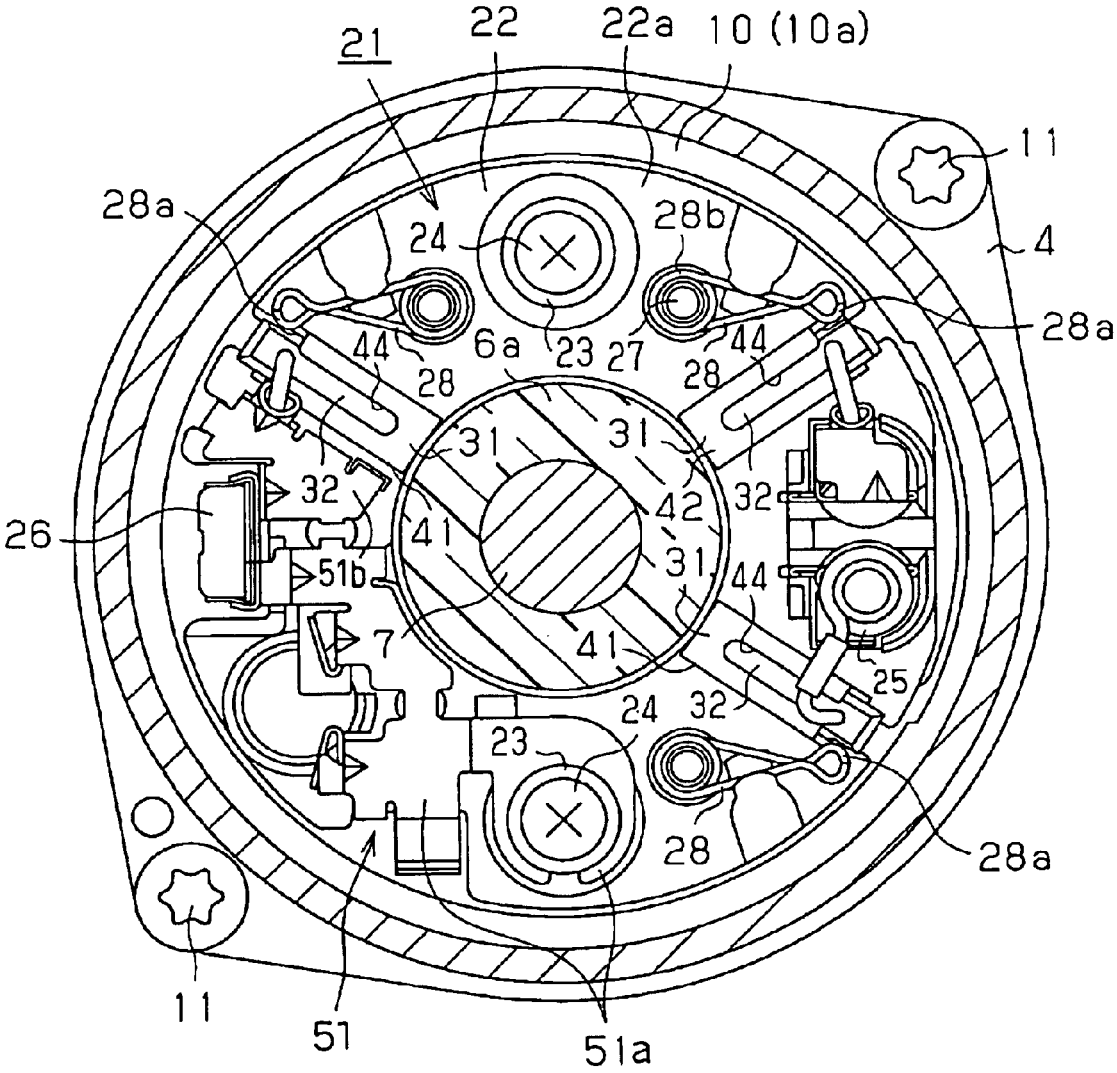
FIG. 2 is a cross sectional view taken along line II—II in FIG. 1.

As shown in FIG. 2, a brush holder device 21, which constitutes a portion of the motor unit 2, is installed to the opening 10*a* of the gear housing 10. The brush holder device 21 includes a generally annular holder base 22. The holder base 22 is made of a dielectric resin material, preferably thermoset resin, such as phenolic resin. The rotatable shaft 7 and a commutator 6*a* secured thereto are received through a through hole that extends through a center of the holder base 22. The holder base 22 (the brush holder device 21) is secured to the gear housing 10 at two points by screws 24, each of which is threadably engaged with the gear housing 10 via a corresponding washer 23.

A noise limiting choke coil 25 and a circuit protective circuit breaker 26 are provided on the holder base 22. Furthermore, three brush holders 31 are secured to the holder base 22. Each brush holder 31 receives a corresponding power supply brush 32 in a slidable manner in a sliding direction (a radial direction of the holder base 22) toward and away from the commutator 6*a* and slidably engages the commutator 6*a*. The brushes 32 include a common ground brush (hereinafter simply referred to as "a common brush") 32, a high speed brush 32 and a low speed brush 32, which are circumferentially arranged in this order right after the circuit breaker 26 in a clockwise direction in FIG. 2. The high speed brush 32 is powered when the motor 1 is driven to rotate at a predetermined high speed to swing the wipers 100 at a high speed. The low speed brush 32 is powered when the motor 1 is driven to rotate at a predetermined low speed to swing the wipers 100 at a low speed. The common brush 32 is commonly used for grounding purpose in both of the time of powering the high speed brush 32 and the time of powering the lower speed brush 32. The components, such as the brushes 32, the choke coil 25 and the circuit breaker 26, are electrically connected. Thus, electric power is supplied from a vehicle side to the wiper motor 1 through a connector 14 (FIG. 1) to provide electric power to, for example, the brushes 32. Furthermore, the motor 1 is grounded through a terminal plate arrangement 51 shown in FIG. 2 and one of the screws 24. More specifically, the terminal plate arrangement 51 includes a terminal plate element 51*a* and a terminal plate element 51*b*. The terminal plate element 51*b* electrically connects between the circuit breaker 26 and the common brush 32, which is next to the circuit breaker 26 in the clockwise direction in FIG. 2. The terminal plate element 51*a* electrically connects between the circuit breaker 26 and the grounded screw 24, which is located in the lower side in FIG. 2. Thus, the common brush 32 is grounded through the terminal plate elements 51*a*, 51*b*, the circuit breaker 26 and the grounded screw 24. The circuit breaker 26 disconnects between the common brush 32 and the grounded screw 24 and thereby stops electric current, which passes through the common brush 32, when the electric current, which passes through the common brush 32, becomes equal to or greater than a predetermined value. The circuit breaker 26 also stops the electric current, which passes through the common brush 32, when temperature becomes equal to or greater than a predetermined temperature due to heat generated by electric current, which passes through the common brush 32.

Figure 3:
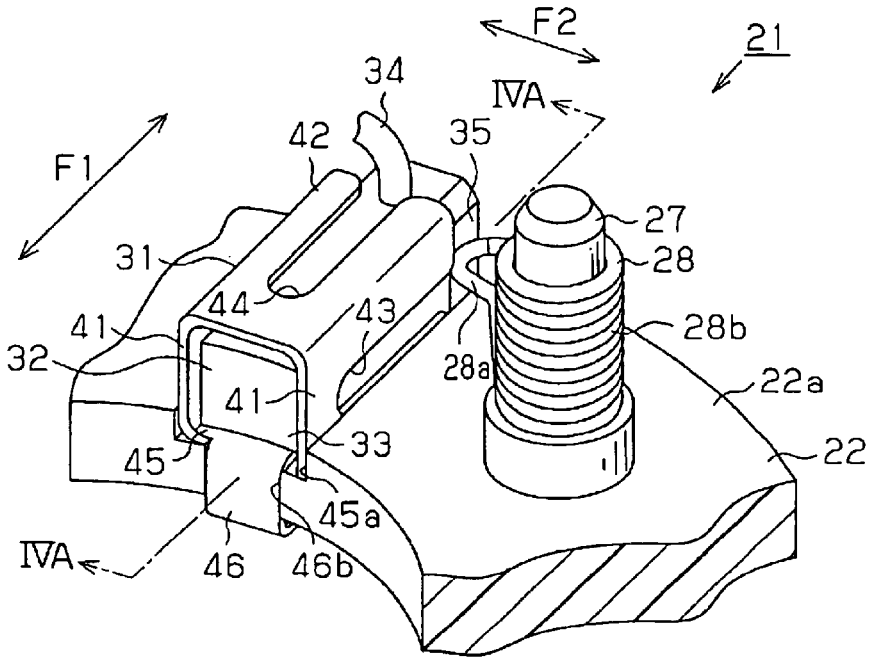
FIG. 3 is a partial perspective view of a brush holder device of the motor.

As shown in FIG. 3, each brush 32 is formed into a generally rectangular parallelepiped shape. A generally arcuate recess 33, which contacts a sliding surface of the commutator 6*a*, is formed in a distal end (i.e., a radially inner end) of the brush 32. Furthermore, a pigtail 34 is connected to a top surface of the brush 32.

Support pins 27 project from a front surface 22*a* of the holder base 22 on a first side of the holder base 22 at three locations near the brush holders 31, respectively. Furthermore, torsion springs 28 are provided to the support pins 27, respectively. Each torsion spring 28 urges the corresponding brush 32 against the commutator 6*a*. One end of the torsion spring 28 includes an engaging projection 28*a*, which engages an engaging portion 35 formed in one lateral side surface of the brush 32. A coiled support portion 28*b* is provided in an intermediate part of each torsion spring 28. An inner diameter of the support portion 28*b* is substantially the same as an outer diameter of the corresponding support pin 27.

Each torsion spring 28 is supported in such a manner that the support pin 27 is received in the support portion 28*b*. The engaging projection 28*a* of the torsion spring 28 engages the engaging portion 35 of the corresponding brush 32. The torsion spring 28 temporarily holds the brush 32 in a retracted state (state shown in FIGS. 2 and 3) within the brush holder 31 by the urging force generated by the torsion spring 28 around the support pin 27. Upon installation of the armature 6, the engaging projection 28*a* of the torsion spring 28 disengages from the engaging portion 35 of the brush 32 and pushes a rear surface of the brush 32, which is opposite from the commutator 6*a*. In this way, the temporarily held state of the brush 32 is released, and the brush 32 is urged against the commutator 6*a* by the torsion spring 28.

The brush holder 31 is desirably made of a metal material, which has a low resistance for limiting generation of heat and has a relatively small spring property to allow bending of the metal material and retainment of the bent state of the metal material. For example, the brush holder 31 is formed from a metal plate made of, for example, brass or stainless through punching and bending of the metal plate with use of a press machine. As shown in FIG. 5B, the brush holder 31 has a lateral wall (a first lateral wall) 41, a top wall 42, another opposed lateral wall (a second lateral wall) 41 and a base wall 45, which are arranged continuously in this order and are respectively bent at a right angle to form a rectangular cross section. A lower part of each brush holder 31 (i.e., lower parts of the lateral walls 41 and the base wall 45) is arranged in a corresponding holder limiting groove 45*a*, which is formed in the front surface 22*a* of the holder base 22. In this way, the thus bent brush holder 31 is prevented from deformation which would be otherwise initiated at a space between an edge of the base wall 45 and an adjacent edge of the adjacent lateral wall 41 that is not continuously formed with the base wall 45.

As shown in FIG. 3, an elongated notch 43 is formed in each of the lateral walls 41 of each brush holder 31 within a movable range of the engaging projection 28*a* of the corresponding torsion spring 28. Furthermore, an elongated notch 44 is formed in the top wall 42 of each brush holder 31 within a movable range of the pigtail 34. These notches 43, 44 are formed at the time of punching the metal plate.

Figure 4A:
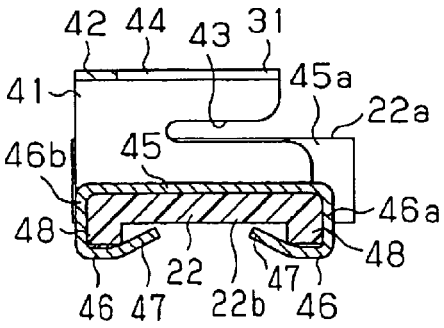
FIG. 4A is a cross sectional view taken along line IVA—IVA in FIG. 3.
Figure 5A:
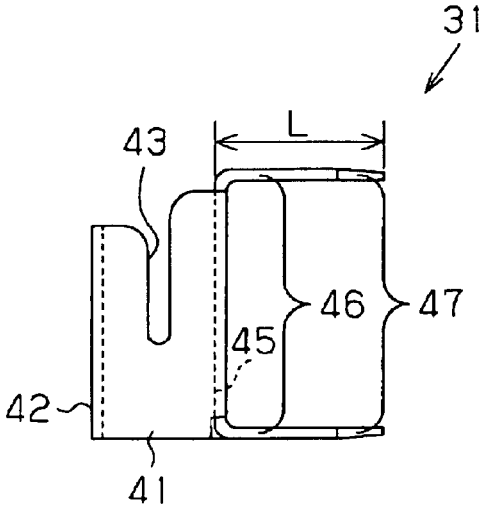
FIG. 5A is a side view of a brush holder of the brush holder device with unbent securing claws.
Figure 5B:
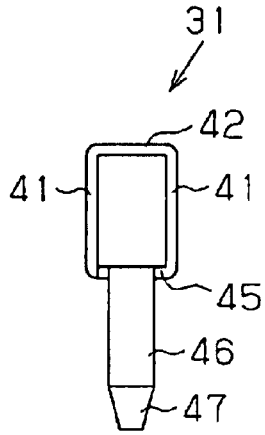
FIG. 5B is an end view of the brush holder of FIG. 5A.

As shown in FIGS. 3 and 5A, two securing claws 46 are provided and are bent at opposed radial ends of the base wall 45, which are opposed to one another in the moving direction (the direction of arrow F1) of the brush 32. As shown in FIG. 4A, one of the securing claws 46 is bent toward the other one of the securing claws 46, and the other one of the securing claws 46 is bent toward the one of the securing claws 46. The one of the securing claws 46 is bent such that the one of the securing claws 46 is held in a claw groove 46*a*, which extends in a thickness direction of the holder base 22 (i.e., in a direction perpendicular to the imaginary plane of the holder base 22) in an outer peripheral part of the holder base 22. The other one of the securing claws 46 is bent such that the other one of the securing claws 46 is held in a claw groove 46*b*, which extends in the thickness direction of the holder base 22 in an inner peripheral part of the holder base 22. A radial depth of the claw groove 46*b* is generally the same as or slightly greater than a plate thickness of the securing claw 46. Thus, the securing claws 46 are received in the claw grooves 46*a*, 46*b*, respectively, and do not protrude from outer and inner peripheral edges, respectively, of the holder base 22. Furthermore, each of the claw grooves 46*a*, 46*b* has a circumferential width that is generally the same as that of the securing claw 46 and is communicated with the holder limiting groove 45*a*. Each securing claw 46 is received in the corresponding claw groove 46*a*, 46*b* and engages inner lateral surfaces of the corresponding claw groove 46*a*, 46*b*, which are opposed to one another in a circumferential direction of the holder base 22. Thus, wobbling of the brush holder 31 in the circumferential direction (the direction of arrow F2 shown in FIG. 3) is limited. The securing claws 46 project in a rear surface (a base surface) 22*b* of the holder base 22 on a second side of the holder base 22.

Figure 4B:
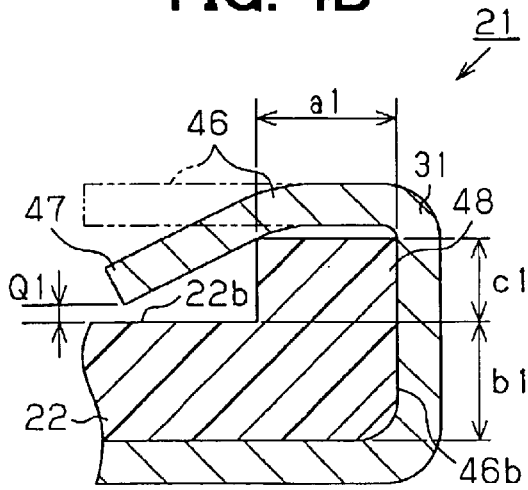
FIG. 4B is an enlarged inverted partial view of FIG. 4A.

As shown in FIGS. 4B and 5A, a length L of each securing claw 46 is set to be greater than the sum of a plate thickness b1 of the holder base 22, a height c1 of a corresponding staking projection 48 that projects from the rear surface 22*b* of the holder base 22 at the corresponding one of the outer peripheral part and the inner peripheral part of the holder base 22, and a radial width al of the corresponding staking projection 48. Thus, a retorted portion 47, which is formed in a distal free end of the securing claw 46, extends beyond a top of the staking projection 48 and is bent to be angled relative to an imaginary plane of the holder base 22 (i.e., a plane of the rear surface 22*b* of the holder base 22), so that the retorted portion 47 is retorted toward the rear surface 22*b* of the holder base 22. The staking projection 48 is formed into a generally rectangular parallelepiped shape and has a circumferential width that substantially coincides with that of the securing claw 46.

Furthermore, a height Q1, which is measured from the rear surface 22*b* of the holder base 22 to a distal end of the retorted portion 47, is smaller than the height c1 of the staking projection 48. Thus, even though the distal end of the retorted portion 47 does not closely engage the rear surface 22*b* of the holder base 22 due to the springback property of the metal, the retorted portion 47 can effectively hold the staking projection 48. Thus, the brush holder 31 is secured to the holder base 22 by the staking without causing wobbling of the brush holder 31.

Figure 6:
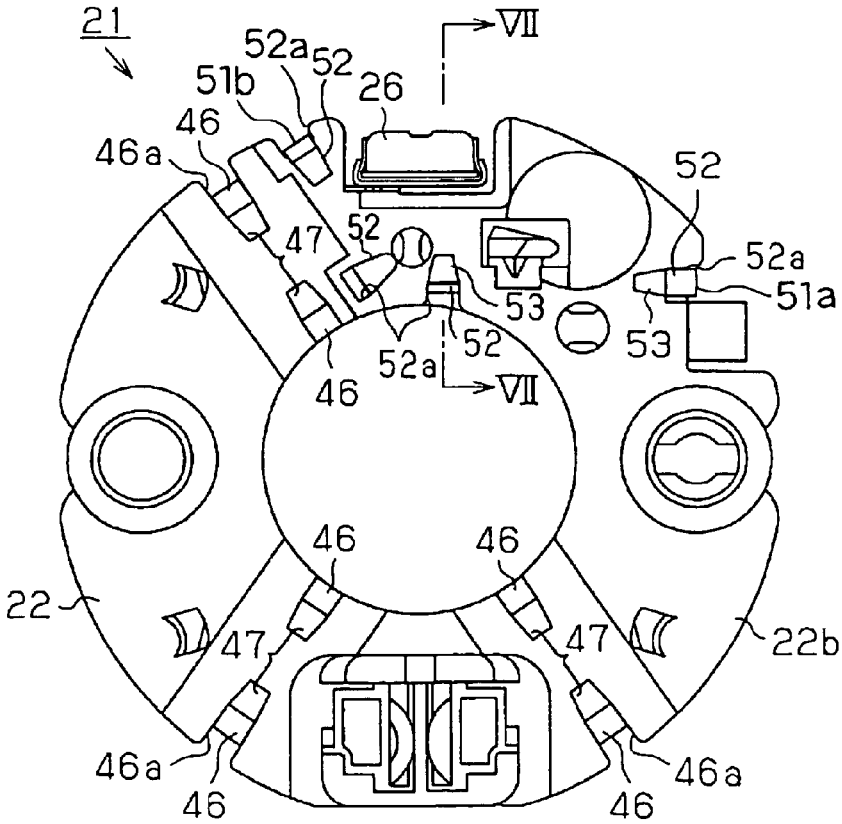
FIG. 6 is a rear view of the brush holder device.

As shown in FIG. 2, the terminal plate elements 51*a*, 51*b* are secured to the holder base 22. Each terminal plate element 51*a*, 51*b* is formed by punching and bending a metal plate made of, for example, brass using a press machine or the like. A plurality of securing claws 52 is formed and is bent in each terminal plate element 51*a*, 51*b*. Each securing claw 52 is formed simultaneously at the time of punching the metal plate. Furthermore, each securing claw 52 is bent to be held in a corresponding claw groove (or a claw through hole in a case of the radially inner securing claw 52 of the terminal plate element 51*b* shown in FIG. 6) 52*a*, which extends in the thickness direction of the holder base 22 at a corresponding one of the outer peripheral part and the inner peripheral part of the holder base 22. A radial depth of the claw groove 52*a* is equal to or greater than the plate thickness of the securing claw 52. With this arrangement, the securing claw 52 is received in the claw groove 52*a* and does not protrude from the peripheral edge of the holder base 22. Furthermore, the claw groove 52*a* is formed to have a circumferential width that is substantially the same as that of the securing claw 52. In this way, the securing claw 52 is received in the claw groove 52*a* and engages an inner surface of the claw groove 52*a*, so that wobbling of the terminal plate element 51*a*, 51*b* is effectively limited. Each securing claw 52 projects from the rear surface 22*b* side of the holder base 22.

Figure 7:
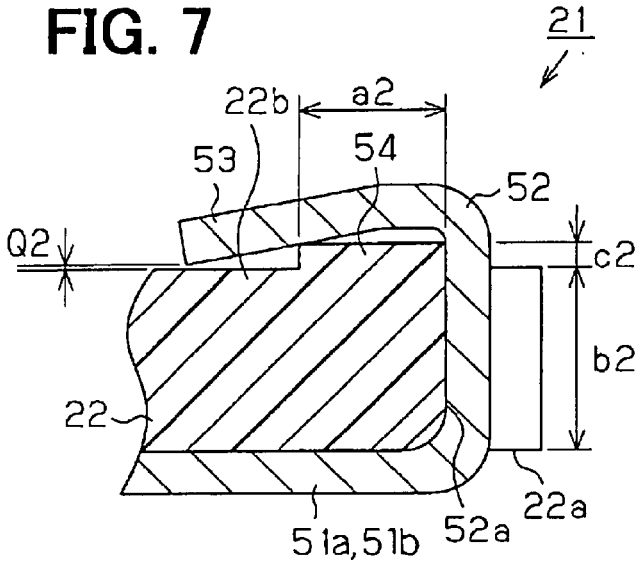
FIG. 7 is a cross sectional view taken along line VII—VII in FIG. 6.

With reference to FIG. 7, a length of the securing claw 52 is set to be greater than the sum of a plate thickness b2 of the holder base 22, a height c2 of a corresponding staking projection 54 that projects from the rear surface 22*b* of the holder base 22 at the corresponding one of the outer peripheral part and the inner peripheral part of the holder base 22, and a radial width a2 of the corresponding staking projection 54. Thus, a retorted portion 53, which is formed in a distal free end of the securing claw 52, extends beyond a top of the staking projection 54 and is bent to be angled relative to the imaginary plane of the holder base 22, so that the retorted portion 53 is retorted toward the rear surface 22*b* of the holder base 22. The staking projection 54 is formed into a generally rectangular parallelepiped shape and has a circumferential width that substantially coincides with that of the securing claw 52.

Furthermore, a height Q2, which is measured from the rear surface 22*b* of the holder base 22 to a distal end of the retorted portion 53, is smaller than the height c2 of the staking projection 54. Thus, even though the distal end of the retorted portion 53 does not closely engage the rear surface 22*b* of the holder base 22 due to the springback property of the metal, the retorted portion 53 can effectively hold the staking projection 54. Thus, the terminal plate element 51*a*, 51*b* is secured to the holder base 22 by the staking without causing wobbling of the terminal plate element 51*a*, 51*b*.

Figure 8A:
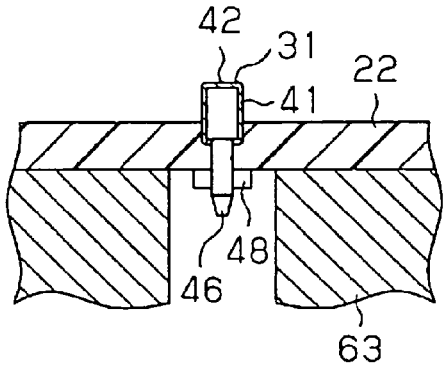
FIG. 8A is a schematic cross sectional view showing one stage of assembly of the brush holder.
Figure 8B:
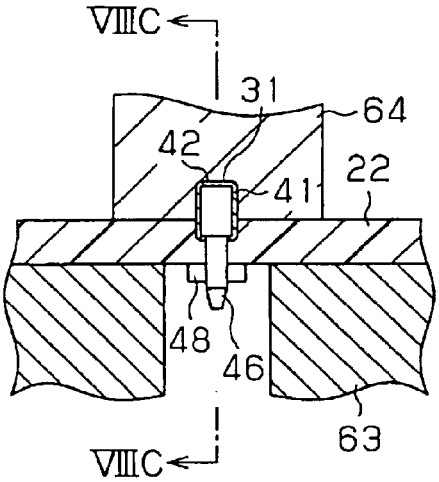
FIG. 8B is a schematic cross sectional view similar to FIG. 8A, showing another stage of the assembly of the brush holder.
Figure 8C:
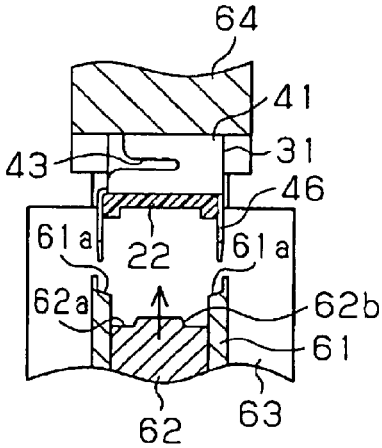
FIG. 8C is a schematic cross sectional view taken along line VIIIC—VIIIC in FIG. 8B, showing another stage of the assembly of the brush holder.

As shown in FIG. 8C, the securing claws 46 of each brush holder 31 are secured simultaneously to the holder base 22 by the staking through use of a first jig 61 and a second jig 62. Two first type guide portions 61*a* are formed in two points, respectively, in the top of the first jig 61 to partially bend the securing claws 46, which project from the rear surface 22*b* of the holder base 22, toward each other.

The second jig 62 is vertically movable in the first jig 61. Two recesses 62*a* are formed at two sides, respectively, in the top of the second jig 62 to further bend the securing claws 46, which have been partially bent by the first type guide portions 61*a*, to engage the securing claws 46 with the rear surface 22*b* of the holder base 22. A second type guide portion 62*b* is formed at a laterally inner edge of each recess 62*a* to angle the corresponding retorted portion 47 in such a manner that the distal end of the retorted portion 47 closely engages the rear surface 22*b* of the holder base 22.

Figure 8D:
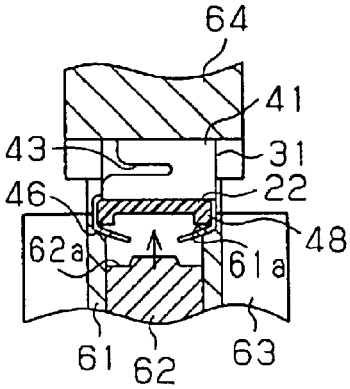
FIG. 8D is a schematic cross sectional view similar to FIG. 8C, showing another stage of the assembly of the brush holder.
Figure 8E:
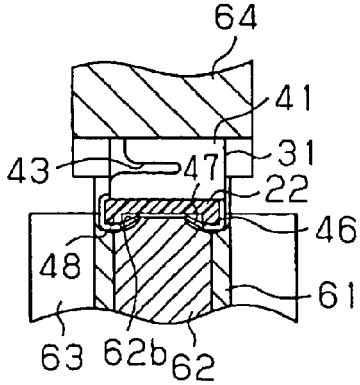
FIG. 8E is a schematic cross sectional view similar to FIG. 8C, showing another stage of the assembly of the brush holder.

The securing claws 46 are secured to the holder base 22 by the staking through use of the first and second jigs 61, 62 in the following manner. First, as shown in FIG. 8A, the brush holder 31 is positioned on the holder base 22 in such a manner that the securing claws 46 extend from the front surface 22*a* of the holder base 22 and project from the rear surface 22*b* of the holder base 22. Furthermore, the rear surface 22*b* of the holder base 22 is supported by a pedestal 63. Next, as shown in FIG. 8B, a holder guide 64 is positioned such that the holder guide 64 supports the lateral walls 41 and the top wall 42 of the brush holder 31 and secure the holder base 22. At this time, as shown in FIG. 8C, the first and second jigs 61, 62 are positioned below the securing claws 46, which project from the holder base 22, in such a manner that the first type guide portions 61*a* of the first jig 61 are placed above the top end of the second jig 62. It should be noted that FIGS. 8C-8E show views taken along line VIIIC—VIIIC in FIG. 8B.

In this state, when the holder guide 64 and the jigs 61, 62 are moved toward each other, the first type guide portions 61*a* of the first jig 61 engage outer sides of the securing claws 46, which project from the rear surface 22*b* of the holder base 22, so that the securing claws 46 are partially bent toward each other. When the second jig 62 is moved upward relative to the first jig 61, a base surface of each recess 62*a* of the second jig 62 engages the partially bent retorted portion 47 of the corresponding securing claw 46, so that the retorted portion 47 is placed beyond the corresponding staking projection 48 and becomes parallel to the rear surface 22*b* of the holder base 22. Then, as shown in FIG. 8E, each retorted portion 47 is retorted by the corresponding second type guide portion 62*b* toward the rear surface 22*b* of the holder base 22, so that the retorted portion 47 closely engages the rear surface 22*b* of the holder base 22.

As a result, the retorted portion 47 of the securing claw 46 is placed beyond the staking projection 48 and is retorted toward the holder base 22, so that the amount of retortion of the securing claw 46 can be increased by the staking projection 48. Furthermore, the retorted portion 47 is bent to be angled toward the holder base 22, so that one side of the securing claw 46 is engaged with a front edge of.the staking projection 48. As a result, the distal end of the retorted portion 47 is returned backward by the springback property of the metal. Therefore, even though the retorted portion 47 does not closely engage the rear surface 22*b* of the holder base 22, the retorted portion 47 can effectively hold the staking projection 48. Thus, the securing claws 46 can be secured to the holder base 22 by the staking without causing wobbling of the securing claws 46.

Furthermore, each brush holder 31 can be secured to the holder base 22 by the staking without causing wobbling of the brush holder 31 and without requiring a large press load for securing the securing claws 46 by the staking. Thus, it is possible to avoid deformation of the holder base 22 or damage of the holder base 22, which would be caused by application of the large press load.

The above embodiment provides the following advantages.

(1) The retorted portion 47, 53 of each securing claw 46, 52 is retorted beyond the top of the corresponding staking projection 48, 54, so that the amount of retortion of the securing claw 46, 52 can be increased by the staking projection 48, 54. Furthermore, each retorted portion 47, 53 is bent to be angled relative to the plane of the holder base 22, so that the one side of the securing claw 46, 52 engages the front edge of the corresponding staking projection 48, 54. Thus, even though the distal end of each securing claw 46, 52 does not closely engage the rear surface 22*b* of the holder base 22 due to the springback property of the metal, the retorted portion 47, 53 can effectively hold the corresponding staking projection 48, 54. Thus, each securing claw 46, 52 is secured to the holder base 22 by the staking without causing wobbling of the securing claw 46, 52.

(2) Each of the brush holders 31 and the terminal plate elements 51*a*, 51*b* can be secured to the holder base 22 without causing wobbling and without requiring the large press load for securing the securing claws 46, 52 by the staking. Thus, it is possible to avoid deformation of the holder base 22 or damage of the holder base 22, which would be caused by application of the large press load.

Furthermore, the securing claws 46, 52 can be secured to the holder base 22 without requiring the receiving through holes of the prior art for receiving the securing claws 46, 52. Thus, it is possible to limit or minimize a reduction in the strength of the holder base 22. As a result, the deformation of the holder base 22 or the damage of the holder base 22, which is caused by the staking process of the securing claws 46, 52 against the holder base 22, can be advantageously limited.

(3) The two securing claws 46 of each brush holder 31 are opposed to one another in the moving direction (the direction of arrow F1) of the brush 32 and are secured to the holder base 22 by the staking. The one of the securing claws 46 is bent toward the other one of the securing claws 46, and the other one of the securing claws 46 is bent toward the one of the securing claws 46. Thus, the securing claws 46 are effectively secured to the holder base 22 in the moving direction of the brush 32. As a result, the wobbling of the brush holder 31 in the moving direction of the brush 32 can be effectively limited.

(4) The metal brush holder 31 is formed to have the rectangular cross section with the base wall 45. Thus, unlike the case where the base wall 45 is not formed in the brush holder 31, it is possible to limit melting of a contact surface of the resin holder base 22, which is in contact with the brush 32, by heat generated from the brush 32 due to internal resistance of the brush 32 at the time of power supply to the brush 32. Thus, it is possible to avoid deformation of the surface of the holder base 22, which would prevent smooth movement of the brush 32. Furthermore, a total contact surface area between the brush 32 and the brush holder 31 is increased, so that more effective release of heat from the brush holder 31 can be achieved.

(5) Each securing claw 46, 52 is secured to the holder base 22 by the staking at the corresponding one of the outer peripheral part and the inner peripheral part of the holder base 22 while the securing claw 46, 52 is received in the corresponding claw groove 46*a*, 46*b*, 52*a*, which extends in the thickness direction of the holder base 22. Thus, each securing claw 46, 52 can be arranged such that the securing claw 46, 52 does not protrude from the corresponding peripheral edge of the holder base 22 in the moving direction (the direction of arrow F1) of the brush 32. Therefore, it is possible to avoid an increase in the size of the brush holder device 21.

Furthermore, the securing claw 46, 52 is engaged with the inner surface of the claw groove 46*a*, 46*b*, 52*a*, so that each brush holder 31 and each terminal plate element 51*a*, 51*b* are secured to the holder base 22 without positional deviation in the circumferential direction (the direction arrow F2) of the holder base 22. Thus, when the brush 32 is vibrated in the circumferential direction of the holder base 22 due to the sliding engagement with the commutator 6*a*, it is possible to limit wobbling of each brush holder 31 and each terminal plate element 51*a*, 51*b* in the circumferential direction.

(6) The length L of each securing claw 46 is set to be greater than the sum of the plate thickness b1 of the holder base 22, the height c1 of the corresponding staking projection 48 and the radial width a1 of the corresponding staking projection 48. Furthermore, the length of the securing claw 52 is set to be greater than the sum of the plate thickness b2 of the holder base 22, the height c2 of the corresponding staking projection 54 and the radial width a2 of the corresponding staking projection 54. Thus, the distal end of each securing claw 46, 52 is placed beyond the corresponding staking projection 48, 54, and thereby the retorted portion 47, 53 is effectively formed.

(7) The height Q1, which is measured from the rear surface 22*b* of the holder base 22 to the distal end of the retorted portion 47, is smaller than the height c1 of the staking projection 48. Furthermore, the height Q2, which is measured from the rear surface 22*b* of the holder base 22 to the distal end of the retorted portion 53, is smaller than the height c2 of the staking projection 54. Thus, even though the distal end of the retorted portion 47, 53 does not closely engage the rear surface 22*b* of the holder base 22 due to the springback property of the metal, the retorted portion 47, 53 can effectively hold the staking projection 48, 54. Thus, each of the brush holders 31 and the terminal plate elements 51*a*, 51*b* is secured to the holder base 22 by the staking without causing wobbling of the brush holder 31 or of each terminal plate element 51*a*, 51*b*.

(6) Each securing claw 46 is sequentially secured to the holder brush 22 by the staking through the process of partially bending the securing claw 46, the process of bending the retorted portion 47 of the securing claw 46 in parallel to the rear surface 22*b* of the holder base 22 and the process of retorting the retorted portion 47 toward the rear surface 22*b* of the holder base 22. Thus, application of excess stress to the securing claw 46 can be advantageously limited.

The above embodiment can be modified as follows.

In the above embodiment, the base wall 45 of the brush holder 31 can be eliminated. In such a case, the cross section of the brush holder 31 has a square horseshoe shape, and a plurality of securing claws 46 is provided to the lower edges of the two lateral walls 41.

In the above embodiment, at least one of the claw grooves 46*a*, 46*b*, 52*a* can be eliminated, if desired.

In the above embodiment, at least one receiving through hole for receiving one or both of each securing claw 46 and each securing claw 52 can be formed through the holder base 22. In this case, each corresponding securing claw 46, 52 is inserted through the corresponding receiving through hole and is then secured to the holder base 22 by staking.

In the above embodiment, each staking projection 48, 54 is formed into the rectangular parallelepiped shape. However, the shape of each staking projection 48, 54 is not limited to this. More specifically, as long as the corresponding securing claw 46, 52 can be placed beyond the top of the staking projection 48, 54 and can be retorted toward the holder base 22, each staking projection 48, 54 can have any other appropriate shape, such as one with an arcuate cross section (e.g., a half cylindrical shape).

The brush holder device 21 is not limited to be used in the wiper motor 1. The brush holder device 21 can be used in any other dynamo-electric machines, such as a power generator or motors other than the wiper motor 1.

Additional advantages and modifications will readily occur to those skilled in the art. The invention in its broader terms is therefore not limited to the specific details, representative apparatus, and illustrative examples shown and described.

What is claimed is:

1. A brush holder device for a dynamoelectric machine, the brush holder device comprising:

a holder base that has axially opposed first and second sides and includes a plurality of staking projections, each of which projects from a base surface of the holder base on the second side of the holder base;

at least one brush holder that is made from a metal plate that is bent into a predetermined shape and is securely installed to the first side of the holder base, wherein:

each of the at least one brush holder includes a plurality of securing claws, which are secured to the holder base by staking; and each securing claw includes a retorted portion, which is retorted toward the base surface on the second side of the holder base beyond a top of a corresponding one of the plurality of staking projections; and at least one brush, each of which is received in a corresponding one of the at least one brush holder in a slidable manner in a sliding direction toward and away from a commutator of the dynamoelectric machine.

2. The brush holder device according to claim 1, wherein the plurality of securing claws of each of the at least one brush holder includes two securing claws, which are opposed to each other in the sliding direction of a corresponding one of the at least one brush and are bent toward each other.

3. The brush holder device according to claim 1, wherein:

the holder base is made of a dielectric resin material; and each of the at least one brush holder has a generally rectangular cross section and includes:

opposed first and second lateral walls;

a top wall that is placed between the first and second lateral walls; and a base wall that is placed between the first and second lateral walls and is opposed to the top wall.

4. The brush holder device according to claim 3, wherein the fist and second lateral walls, the top wall, the base wall and the plurality of securing claws of each of the at least one brush holder are formed by bending the metal plate.

5. The brush holder device according to claim 1, wherein the holder base further includes a plurality of claw grooves, each of which is provided in a corresponding one of an outer peripheral edge and an inner peripheral edge of the holder base and extends in a direction generally perpendicular to a plane of the holder base to receive a corresponding one of the plurality of securing claws of the at least one brush holder.

6. The brush holder device according to claim 1, wherein each securing claw of each of the at least one brush holder has a length that is greater than a sum of a plate thickness of the holder base, a height of the corresponding one of the plurality of staking projections and a radial width of the corresponding one of the plurality of staking projections.

7. The brush holder device according to claim 1, wherein a height, which is measured from the base surface of the holder base to a distal end of the retorted portion of each of the plurality of securing claws of each of the at least one brush holder, is smaller than a height of the corresponding one of the plurality of staking projections.

8. The brush holder device according to claim 1, wherein the dynamoelectric machine is a motor.

9. The brush holder vice according to claim 8, wherein:

the motor is a wiper motor for driving at least one wiper;

the at least one brush holder includes three brush holders; and the at least one brush includes:

a high speed brush that is powered when the motor is driven to rotate at a predetermined high speed to swing the at least one wiper at a high speed;

a low speed brush that is powered when the motor is driven to rotate at a predetermined low speed to swing the at least one wiper at a low speed; and a common brush that is commonly used in both of the time of powering the high speed brush and the time of powering the lower speed brush.

10. The brush holder device according to claim 1, wherein a distal end of the retorted portion of each securing claw of the at least one brush holder is spaced away from the base surface of the holder base on the second side of the holder base.

11. A brush holder device for a dynamoelectric machine, the brush holder device comprising:

a holder base that has axially opposed first and second sides and includes at least one staking projection, which projects from a base surface of the holder base on the second side of the holder base;

at least one brush holder that is made from a metal plate that is bent into a predetermined shape and is securely installed to the holder base;

at least one brush, each of which is received in a corresponding one of the at least one brush holder in a slidable manner in a sliding direction toward and away from a commutator of the dynamoelectric machine; and at least one terminal plate element that is made from metal and is securely installed to the first side of the holder base such that the at least one terminal plate element is electrically connected to at least one of the at least one brush, wherein:

each of the at least one terminal plate element includes at least one securing claw, which is secured to the holder base by staking; and each of the at least one securing claw of each of the at least one terminal plate element includes a retorted portion, which is retorted toward the base surface on the second side of the holder base beyond a top of a corresponding one of the at least one staking projection.

12. The brush holder device according to claim 11, wherein the holder base further includes at least one claw groove, each of which is provided in a corresponding one of an outer peripheral edge and an inner peripheral edge of the holder base and extends in a direction generally perpendicular to a plane of the holder base to receive a corresponding one of the at least one securing claw of the at least terminal plate element.

13. The brush holder device according to claim 11, wherein each securing claw of each of the at least one terminal plate element has a length that is greater than a sum of a plate thickness of the holder base, a height of the corresponding one of the at least one staking projection and a radial width of the corresponding one of the at least one staking projection.

14. The brush holder device according to claim 11, wherein a height, which is measured from the base surface of the holder base to a distal end of the retorted portion of each of the at least one securing claw of each of the at least one terminal plate element, is smaller than a height of the corresponding one of the at least one staking projection.

15. The brush holder device according to claim 11, wherein the dynamoelectric machine is a motor.

16. The brush holder vice according to claim 15, wherein:

the motor is a wiper motor for driving at least one wiper;

the at least one brush holder includes three brush holders; and the at least one brush includes:

a high speed brush that is powered when the motor is driven to rotate at a predetermined high speed to swing the at least one wiper at a high speed;

a low speed brush that is powered when the motor is driven to rotate at a predetermined low speed to swing the at least one wiper at a low speed; and a common brush that is commonly used in both of the time of powering the high speed brush and the time of powering the lower speed brush.

17. The brush holder device according to claim 11, further comprising a circuit breaker, wherein:

at least one of the at least one terminal plate element electrically connects between the circuit breaker and the at least one of the at least one brush; and the circuit breaker stops electric current, which passes through the at least one of the at least one brush, when at least one of the following conditions are satisfied:

the electric current, which passes through the at least one of the least one brush, becomes equal to or greater than a predetermined value; and temperature becomes equal to or greater than a predetermined temperature due to heat generated by electric current, which passes through the at least one of the at least one brush.

* * * * *